US008164263B2

(12) United States Patent
Morimoto et al.

(10) Patent No.: US 8,164,263 B2
(45) Date of Patent: Apr. 24, 2012

(54) EXCIMER DISCHARGE LAMP

(75) Inventors: Yukihiro Morimoto, Hyogo (JP); Kengo Moriyasu, Hyogo (JP)

(73) Assignee: Ushio Denki Kabushiki Kaisha, Tokyo (JP)

( * ) Notice: Subject to any disclaimer, the term of this patent is extended or adjusted under 35 U.S.C. 154(b) by 112 days.

(21) Appl. No.: 12/662,213

(22) Filed: Apr. 6, 2010

(65) Prior Publication Data

US 2010/0259170 A1 Oct. 14, 2010

(30) Foreign Application Priority Data

Apr. 10, 2009 (JP) ..... 2009-095873
Apr. 15, 2009 (JP) ..... 2009-098598
Nov. 2, 2009 (JP) ..... 2009-251900

(51) Int. Cl.
*H01J 11/00* (2006.01)

(52) U.S. Cl. ..... 313/607; 313/609

(58) Field of Classification Search ..... 313/607, 313/609–612
See application file for complete search history.

(56) References Cited

U.S. PATENT DOCUMENTS 4,983,881 A 1/1991 Eliasson et al.
5,444,331 A * 8/1995 Matsuno et al. ..... 313/553
5,514,934 A * 5/1996 Matsumoto et al. ..... 313/607
5,801,495 A * 9/1998 Smolka et al. ..... 315/326
5,889,367 A * 3/1999 Hofmann et al. ..... 313/634
7,164,223 B2 * 1/2007 Lee ..... 313/17
7,772,779 B2 * 8/2010 Bang ..... 313/594
7,800,308 B2 9/2010 Ode et al.
2007/0285015 A1 * 12/2007 Yasuda ..... 313/631
2010/0259168 A1 * 10/2010 Moriyasu et al. ..... 313/607

FOREIGN PATENT DOCUMENTS

JP 64-59754 A 3/1989
JP H02-007353 A 1/1990
JP 06-310106 A 11/1994
JP 2006-244898 A 9/2006
KR 10-2009-0023065 3/2009

OTHER PUBLICATIONS

Japanese Office Action, App. No. 2009-095873, Apr. 18, 2011 (3 pages).

* cited by examiner

*Primary Examiner* — Nimeshkumar Patel
*Assistant Examiner* — Christopher Raabe
(74) *Attorney, Agent, or Firm* — Rader, Fishman & Grauer PLLC

(57) ABSTRACT

An excimer discharge lamp comprises an electric discharge container having an electric discharge space, a pair of electrodes provided on an outer face of the electric discharge container, and an electric discharge gas enclosed in the electric discharge space. Further the electric discharge container comprises a tubular side wall on which the pair of electrodes is formed, one end wall for sealing one end of the side wall, and another end wall that is provided on the other side of the side wall. The side wall and the end walls are made of sapphire, YAG, or single crystal yttria. A chip pipe is provided on the another end wall, and a partition member made of sapphire, YAG, or single crystal yttria is formed between a shortest distance of the chip pipe and the inner face of the side wall.

7 Claims, 10 Drawing Sheets

| | Electric Discharge Starting Voltage |
|---|---|
| Comparative Example | 5.1 kV(p-p) in Average |
| Invention 1 | 6.1 kV(p-p) in Average |
| Invention 2 | 9kV(p-p) or more |

EXCIMER DISCHARGE LAMP

CROSS-REFERENCES TO RELATED APPLICATION

This application claims priority from Japanese Patent Application Serial Nos. 2009-098598 filed Apr. 15, 2009 and 2009-251900 filed Nov. 2, 2009, the contents of which are incorporated herein by reference in their entirety.

TECHNICAL FIELD

The present invention relates to an excimer discharge lamp that emits ultraviolet rays by excimer electric discharge. Further, the present invention relates to an excimer discharge lamp whose electric discharge container is made of sapphire, YAG, or single crystal yttria.

BACKGROUND

Conventionally, an excimer discharge lamp has been used as an ultraviolet ray light source for a photochemical reaction, such as photo-cleaning, surface alteration and sensitization of a chemical substance. For example, rare gas (such as xenon) and halide (such as fluoride), which are enclosed in this excimer discharge lamp, are known as light emission gas. Halogen or halide is ionized at time of lamp lighting, so as to serve as halogen ions, and the reactivity thereof to other substances becomes very high. For this reason, an electric discharge container encloses the halogen or halide of an excimer discharge lamp must take appropriate measures. Japanese Patent Application Publication No. 06-310106 teaches such an excimer discharge lamp that takes such measures.

FIG. 10 is an explanatory cross sectional view of part of the excimer discharge lamp 9 disclosed in the Japanese Patent Application. The excimer discharge lamp 9 is equipped with an electric discharge container 91, titanium caps 911 provided in both ends of the electric discharge container 91, and metal nets 931 and 932 that are provided on an outer face of the electric discharge container 91 so as to be apart from each other.

The electric discharge container 91 is sealed by the titanium caps, using an O ring 921 made of fluorine contained resin system, so that an airtight electrical discharge space is formed inside the electric discharge container 91. This electrical discharge space is filled up with xenon gas and chlorine as electric discharge gas.

A power supply, which is not illustrated in the figure, is connected to the metal nets 931 and 932, and a high voltage of a high frequency is impressed to start the electric discharge. In the electrical discharge space, excimer electric discharge arises and ultraviolet rays with a wavelength band of 300 to 320 nm resulting from the xenon and chlorine are acquired. Since the sapphire pipe 91 has ultraviolet-rays permeability, the lamp emits the ultraviolet rays to the outside of the lamp 9 by the excimer electric discharge.

In the above-mentioned excimer discharge lamp 9, in order to enclose the electric discharge gas in the electrical discharge space, it is necessary to form a chip pipe in the titanium cap 911. Therefore, an excimer discharge lamp shown in FIG. 11, which is an overall view thereof, can be considered.

In FIG. 11, different portions from FIG. 10, will be described below, while similar portion descriptions will be omitted. The chip pipe 94 that leads to the electrical discharge space is connected to the titanium cap 911 provided at one end of the electric discharge container 91 by brazing or other method. Electric discharge gas is enclosed in the electrical discharge space through the chip pipe 94. After enclosing it, in order to seal the electrical discharge space, the chip pipe 94 is cut off for sealing, thereby forming the sealing portion 941 shown in FIG. 11. Material, such as a metal, that be cut off for sealing is used for the chip pipe 94.

When lighting the excimer discharge lamp 9 shown in FIG. 11, electric discharge sometimes does not occur between the pair of metal nets 931 and 932. This variable electric discharge results from an electric discharge arising between the one metal net 931 and the chip pipe 94, because the chip pipe 94 has a low voltage with respect to the one metal net 931.

Japanese Patent Application Publication No. 06-310106 teaches that although the cap 911 may be manufactured with high purity alumina, since the chip pipe 94 must be able to be cut off for sealing, it must be manufactured with metal material. Since electric discharge arises at least between the one metal net 931 and the chip pipe 94, the chip pipe 94 is heated, so that the thermal expansion difference occurs at the brazed portion between the cap 911 and the chip pipe 94 so that it may be damaged. Moreover, even though the portion between the cap 911 and the chip pipe 94 is not damaged, when the chip pipe 94 is heated, the O ring 922 is heated through the cap 911, so that the O-ring 922 deteriorates whereby airtightness of the electric discharge container 91 may not be maintained.

SUMMARY

It is an object of the present invention to offer an excimer discharge lamp in which electric discharge to a chip pipe is suppressed. The excimer discharge lamp according to the present invention, includes an electric discharge container having an electric discharge space thereinside, a pair of electrodes provided on an outer face of the electric discharge container, electric discharge gas enclosed in the electric discharge space and made of at least rare gas, and halogen or halide. The electric discharge container has a tubular side wall on which the pair of electrodes is formed. One end wall seals one end of the side wall. Another end wall is provided on the other side of the side wall. The side wall and the end walls are made of sapphire, YAG or single crystal yttria. A chip pipe is provided on the another end wall. A partition member that made of sapphire, YAG, or single crystal yttria is formed between a shortest distance of the chip pipe and the inner face of the side wall where the pair of electrodes is formed.

In the excimer discharge lamp according to the first invention, by the above-mentioned feature, it is possible to make electric resistance high between the chip pipe and the inner face where the pair of electrodes is provided to suppress the electric discharge to the chip pipe.

In the excimer discharge lamp, a winding flow path is formed by the partition member and the electric discharge container.

In such a case, by the above-mentioned feature, it is possible to make the distance long between the chip pipe and the inner face of the side wall where the pair of electrodes is provided to suppress the electric discharge to the chip pipe.

In the excimer discharge lamp, a dividing wall made of sapphire, YAG, or single crystal yttria may be provided on the end wall located in the shortest distance between the chip pipe and the inner face of the side wall where the pair of electrodes is provided.

In such a case, it is possible to further make electric resistance high between the chip pipe and the inner face of the side wall where the pair of electrodes is provided to suppress the electric discharge to the chip pipe.

BRIEF DESCRIPTION OF DRAWINGS

Other features and advantages of the present excimer discharge lamp will be apparent from the ensuing description, taken in conjunction with the accompanying drawings, in which.

DESCRIPTION

Figure 1:
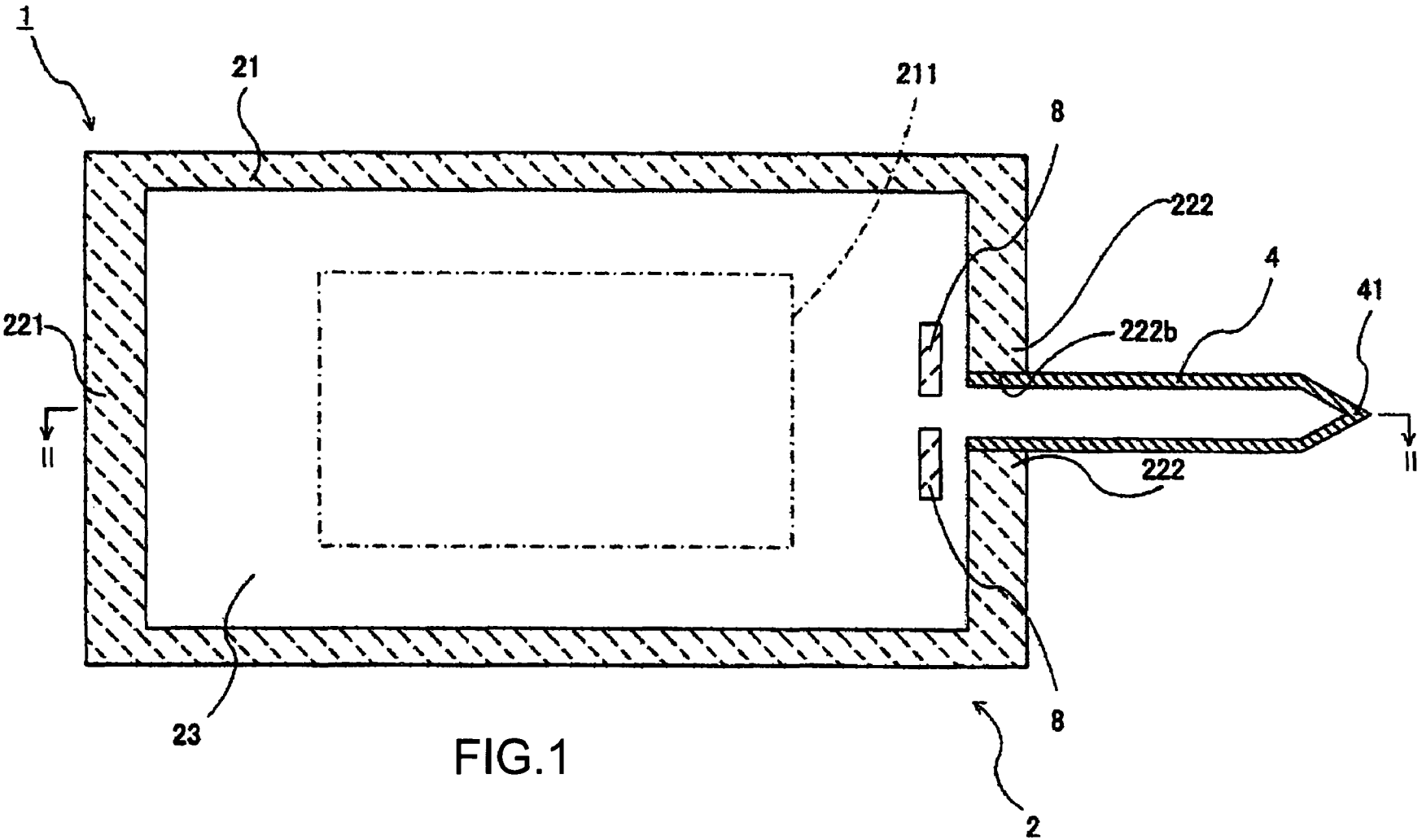
FIG. 1 is an explanatory diagram of an excimer discharge lamp according to the present invention.
Figure 2:
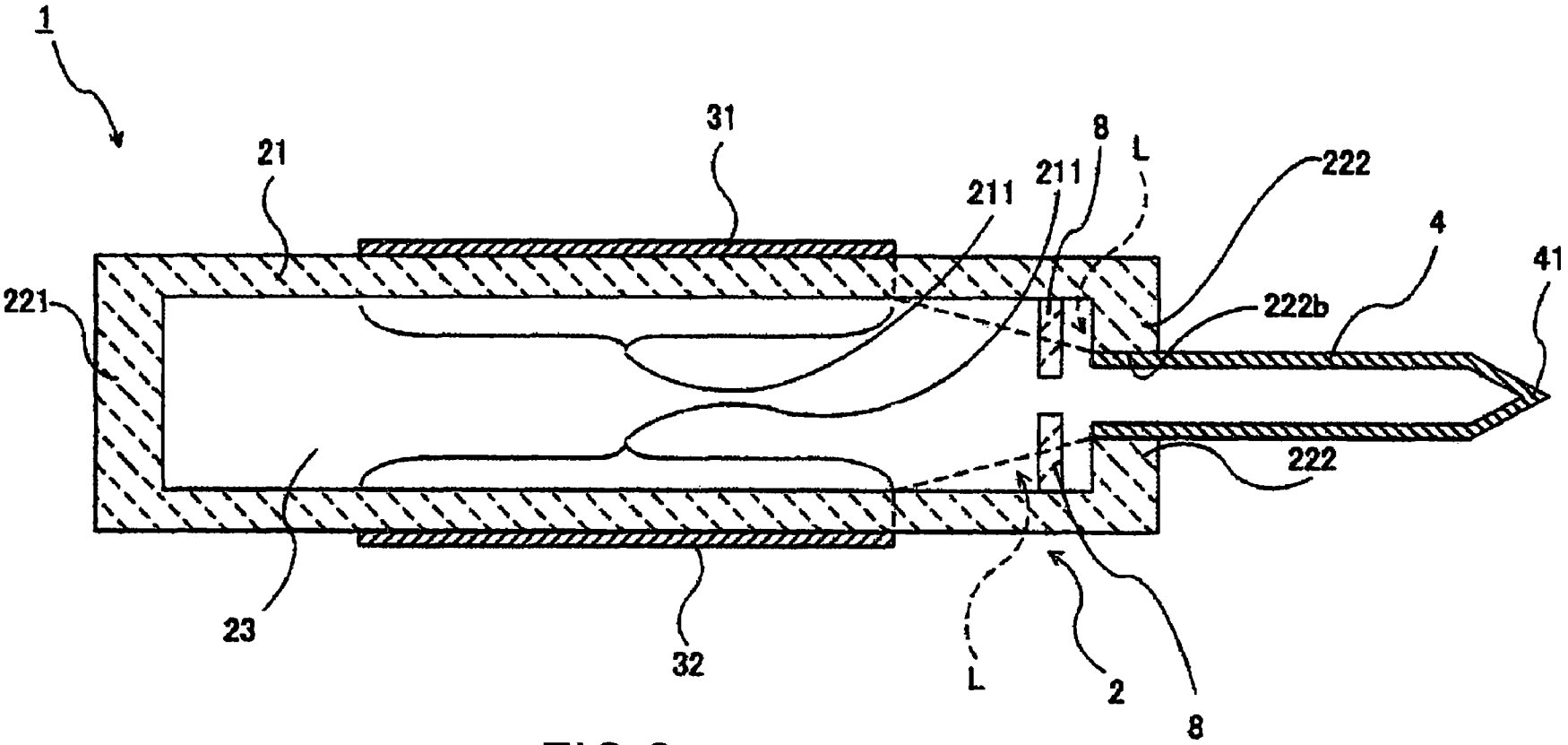
FIG. 2 is an explanatory diagram of an excimer discharge lamp according to the present invention.

FIG. 1 is an explanatory cross sectional view of an excimer discharge lamp 1 according to a first embodiment, taken along a longitudinal direction of an electric discharge container 2. FIG. 2 is a cross sectional view of the lamp 1, taken along the line II-II of FIG. 1.

The excimer discharge lamp according to the present invention is made up of a straight tube shaped electric discharge container 2, a chip pipe 4 provided at an end of the electric discharge container 2, and a pair of electrodes 31 and 32 that is on an outer face of the electric discharge container 2.

This electric discharge container 2 is made up of a straight tube shaped side wall 21, one end wall 221 in a plate shape on an end of the side wall 21, and another annular end wall 222 at the other end of the side wall 21. The side wall 21 and the end walls 221 and 222 are made of sapphire, YAG, or single crystal yttria. A hole 222*b* is formed so as to penetrate the center of the other end wall 222.

Part of the outer circumference of the chip pipe 4 is inserted in the hole 222*b* of the end wall 222. Metallization is performed on a face that forms the hole 222*b*, and brazing metal such as silver solder, is filled in between the chip pipe 4 and the face. Since the chip pipe 4 is a metal material, such as nickel or an alloy material such as stainless steel, the chip pipe 4 is brazed, through brazing metal, to the face where the metallization is performed. In addition, since there is an active metal brazing method as a method for joining metal and ceramics, the chip pipe 4 may be joined with the other end wall 222 by using this active metal brazing method. Specifically, active metal brazing, which contains active metal such as titanium, is used as brazing metal, and the chip pipe 4 and the face that forms the hole 222*b*, are joined to each other by the active metal brazing. In the case of the active metal brazing method, the metallization may not be necessarily performed on the face, that forms the hole 222*b*.

A sealing portion 41 is formed by performing pressure welding on the other end portion (an end portion in the right hand side of the figure) of the chip pipe 4. In this way, an airtight electrical discharge space 23 is formed inside the electric discharge container 2. Rare gas, such as argon (Ar), krypton (Kr) and xenon (Xe); halogen, such as fluoride ($F_2$), chlorine ($Cl_2$), bromine ($Br_2$) and iodine ($I_2$); or halide, such as sulfur hexafluoride ($SF_6$), are enclosed in this electrical discharge space 23 as electric discharge gas.

As show in FIG. 2, a pair of electrodes 31 and 32 is arranged apart from each other on an outer surface of the electric discharge container 2. Thus, the pair of electrodes 31 and 32 face each other through the side wall 21 and the electrical discharge space 23 of the electric discharge container 2.

In the inside of the electrical discharge container 2, an annular partition member 8 is formed at a shortest distance (portion) L between the chip pipe 4 and the inner face 211 of the side wall 21 on which the pair of electrodes 31 and 32 is provided. This partition member 8 is made of sapphire (single crystal alumina $Al_2O_3$), YAG (yttrium aluminum Garnett), or single crystal yttria ($Y_2O_3$). The partition member 8 may be joined to the inner face of the electrical discharge container 2 by pressing and heating, which is described below, or may be joined to the inner face of the electric discharge container 2 by an adhesive agent made of, for example, acrylic adhesive. In addition, the "shortest distance L" according to the first embodiment means that, as shown in FIG. 2, a part between a portion which is closest to the chip pipe 4 on the inner face 211 of the side wall 21 where the pair of electrodes 31 and 32 is provided, and a portion of the chip pipe 4 that is closest to that portion (see one end portion located at the left side of FIG. 2). In the first embodiment, since the electric discharge container 2 may be a rectangular parallelepiped which is a rectangle in a cross sectional view thereof taken in a direction perpendicular to a longitudinal direction and the chip pipe 4 may be cylindrical, as shown in FIG. 2, the shortest distance (portion) L between the chip pipe 4 and the inner face 211 of the side wall 21 on which the one electrode 31 is provided, may be shown as a line segment L. In addition, the shortest distance (portion) L between the chip pipe 4 and the inner face 211 of the side wall 21 on which the other electrode 32 is provided, may be also shown as a line segment L. In the first embodiment, since the shortest distance L between the chip pipe 4 and the inner face 211 of the side wall 21 on which the one electrode 31 is provided, is approximately the same as the shortest distance L between the chip pipe 4 and the inner face 211 of the side wall 21 on which the electrode 32 is provided, the partition members 8 are provided on both of the shortest distance L.

Figure 3A:
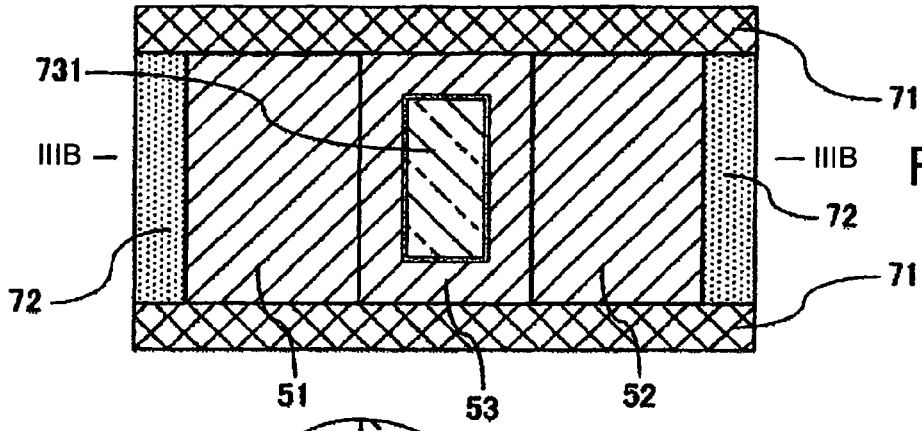
FIGS. 3A-3D are explanatory diagrams of an excimer discharge lamp according to the present invention.
Figure 3B:
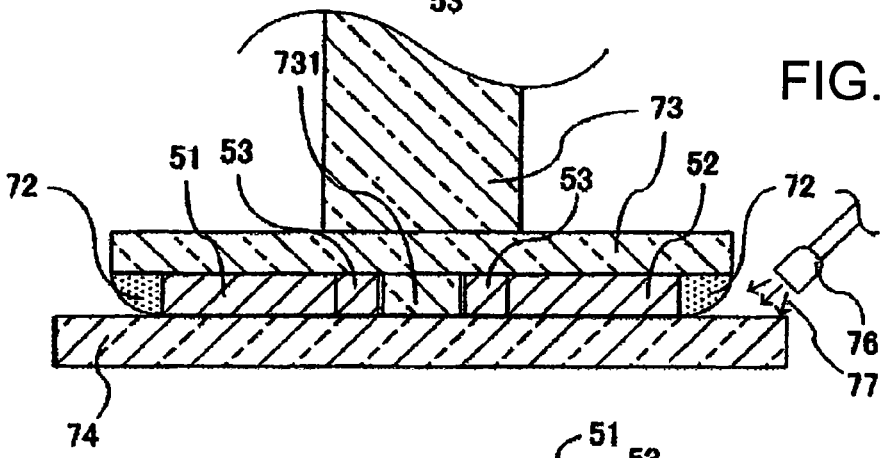
Figure 3C:
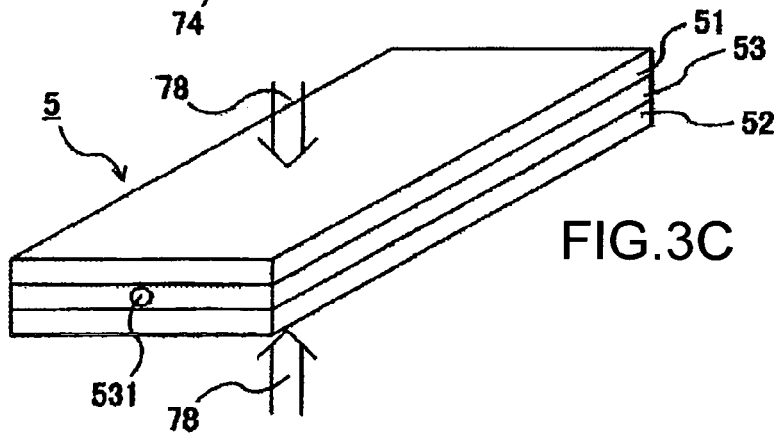
Figure 3D:
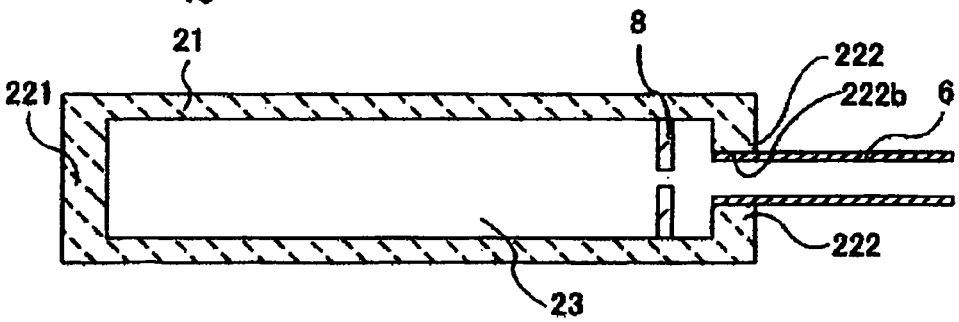

Next, an example of a manufacture method of the excimer discharge lamp 1 is explained referring to FIGS. 3A-3D. FIG. 3A is a top plan view of a pair of plate members 51 and 52 and a rectangular member 53, which are fixed in a jig 71. FIG. 3B is a cross sectional view of the pair of plate members 51 and 52 and the rectangular member 53 that are shown in FIG. 3A, and depict a grinding step thereof (which is taken along the line IIIB-IIIB of FIG. 3A). FIG. 3C is a perspective view thereof, showing a step of heating the pair of plate members 51 and 52 and the rectangular member 53 while pressing them after the grinding step of FIG. 3B. FIG. 3D is a cross sectional view thereof, showing a joining step in which a chip pipe forming material 6 is joined to a discharge container forming material 5. In addition, in FIGS. 3A to 3D, the same numerals as those in FIGS. 1 and 2 are assigned to the same structures as those shown in FIGS. 1 and 2.

For example, three plate members made of sapphire are prepared, and a rectangular hole is formed in one of the plate members so as to penetrate a central part thereof, thereby forming the rectangular member 53. As shown in FIG. 3A, for example, when a face of the rectangular member 53 in the front side of FIG. 3A is ground, the rectangular member 53 is arranged on a support stand (which is indicated as "73" in FIG. 3B, although not shown in FIG. 3A), so that the face to be ground may be located in the front side of FIG. 3A. Since a jig 731 for a hole is provided on the support stand 73, the rectangular member 53 is arranged on the support stand 73 so that the jig 731 for a hole may be located at the center hole. Then, two plate members 51 and 52 are arranged on the right and left of the rectangular member 53 in a state where the faces to be ground face toward a front side. The two plate members 51 and 52 and the rectangular member 53 are covered by the jig 71 and an adhesive agent 72 in the outer circumference thereof, so that they are fixed to the support stand (in FIG. 3B, the support stand is indicated as 73 although not shown in FIG. 3A).

As shown in FIG. 3B, the two plate members 51 and 52 and the rectangular member 53, which have been fixed, are placed so that the faces to be ground (faces thereof in a lower side of FIG. 3B) face a grinding stand 74. In the grinding process, in order to perform three grinding steps (so-called "grinding" step, "lapping" step, and "polishing" step), the grinding stand 74 and the particle size of the abrading agent 77 are changed in each grinding step. First, in the "grinding" step, steel is used as the grinding stand 74. The faces of the two plate members 51 and 52, and the rectangular member 53 that face the grinding stand 74 are ground by the unevenness of the grinding stand 74 or the abrading agent 77, for example, silicon dioxide ($SiO_2$), silicon carbide (SiC), diamond (C) or cerium dioxide ($CeO_2$) are supplied by an abrading agent supply unit 76 between the grinding stand 74 and the faces to be ground. Next, a face in an opposite side to the ground face of the rectangular member 53 (a face in an upper side of FIG. 3B) is ground. Then, in the "wlapping" step, tin is used as the grinding stand 74. The faces of the two plate members 51 and 52, and the rectangular member 53 that face the grinding stand 74 are again ground by the unevenness of the grinding stand 74, or the abrading agent 77, such that silicon dioxide ($SiO_2$), silicon carbide (SiC), diamond (C), or cerium dioxide ($CeO_2$) are supplied by the abrading agent supply unit 76, between the grinding stand 74 and the faces to be ground. The particle size of the abrading agent 77, which is used at this time, is smaller than that of the abrading agent 77, which was used at the time of the "grinding" step. Next, at least a face of the rectangular member 53, which is in an opposite side of the ground face (a face in an upper side of FIG. 3B), is again ground. Finally, in the "polishing" step, aluminum, which has a resin is applied to it, is used as the grinding stand 74. As to the two plate members 51 and 52 and the rectangular member 53, the faces that face the grinding stand 74 are ground again by the abrading agent 77, such as silicon dioxide ($SiO_2$), silicon carbide (SiC), diamond (C), or cerium dioxide ($CeO_2$) that is supplied by the abrading agent supply unit 76, between the face to be ground and the resin of the grinding stand 74. The particle size of the abrading agent 77 used at this time is smaller than that of the abrading agent 77 used at the time of the "wlapping" step. Next, at least a face of the rectangular member 53, which is in an opposite side of the ground face (a face in an upper side of FIG. 3B), is again ground. Thus, the two plate members 51 and 52 and the rectangular member 53 pass through the three grinding steps—"grinding" process, the "wlapping" step, and the "polishing" step—the particle size of the abrading agent 77 becomes gradually smaller.

After grinding the two plate members 51 and 52 and the rectangular member 53 in FIG. 3B, the ground faces are brought into contact so that the two plate members 51 and 52 may be arranged to face each other through the one annular member 53, and laminated. Description thereof will be given below referring to FIG. 3C. One of the ground faces of the rectangular member 53 is brought into contact with one of the ground faces of the plate member 51 (a face in an upper side of FIG. 3C). Moreover, the other ground face of the plate member 52 is brought into contact with the other ground face (a face in a lower side of FIG. 3C) of the rectangular member 53. Therefore, the hole of the rectangular member 53 may be surrounded by the pair of plate members 51 and 52. The partition member formation component (not shown) that will serve as a partition member is arranged in this surrounded hole, and the ground face of the partition member formation component is brought in contact with the ground face of the plate members. The outer faces of the pair of plates 51 and 52 (the face in an upper side of one of the plate members 51 of FIG. 3C and the face in a lower side of the other plate member 52 of FIG. 3C) are pressed by a pressing unit 78 (not shown), so that the ground faces of the two plate members 51 and 52 and the rectangular member 53 are brought into close contact with each other while they are laminated. While the two plate members 51 and 52 and the rectangular member 53 are laminated and pressed, they are heated at, for example, 1300-1400 degrees Celsius for 8 to 15 hours under reduced pressure.

After heating in FIG. 3C, the faces of the two plate members 51 and 52 and the rectangular member 53, after being cooled to room temperature, are joined to each other on their faces that were respectively brought into contact with each other, which forms an integrated member or an electric discharge container forming member 5. In the electric discharge container forming member 5, as shown in FIG. 3D, the electric discharge space 23 resulting from the rectangular member 53 is formed inside, and a through hole 222*b* that leads to the electric discharge space 23 is formed in the other end wall 222 in the longitudinal direction. The partition member 8 joined to the inner face of the side wall 23 is arranged in this electric discharge space 23. After metallization of the through hole 222*b* by a Mo—Mn method, an end of a chip pipe forming member 6, which is made of nickel, is inserted therein. Brazing metal made of silver soldering is filled in between the through hole 222*b* and the outer circumferential face of the chip pipe forming member 6, so that both are joined to each other. After air in the hollow part thereof is discharged from the other end of the chip pipe forming member 6, argon and sulfur hexafluoride are introduced as electric discharge gas in this hollow part of the electric discharge container forming member 5. Since the chip pipe forming member 6 is made of metal, the sealing portion is formed by performing pressure welding on the other end portion of the chip pipe forming member 6. As a result, the hollow part of the electric discharge forming member 5 becomes the airtight electric discharge space 23 and serves as the electric discharge container 2.

Although not shown in the figure, the net electrodes 31 and 32 are formed on the pair of the outer faces of the electric discharge container 2. The net electrodes are formed by applying, for example, copper paste in shape of net on the outer faces of the electric discharge container 2 by printing, and then heating the applied copper paste together with the electric discharge container 2 at high temperature, so as to perform calcination on the copper paste. This completes the excimer discharge lamp 1. When the excimer discharge lamp 1 according to the present invention is formed in such a manner, it is possible to form the sealed electric discharge space 23 without using a resin component.

In addition, the electric discharge container 2 may be a rectangular parallelepiped, which is a rectangle in a cross sectional view thereof taken in a direction perpendicular to a longitudinal direction thereof, or may be a cylindrical shape, which is a circle in a cross sectional view thereof.

According to the first embodiment, a power supply, which is not illustrated, is connected to the pair of electrodes 31 and 32 of the excimer discharge lamp 1. Next, description of an operation at lighting time of the excimer discharge lamp 1 is given.

When high voltage of high frequency is supplied to the excimer discharge lamp 1, electric charges are accumulated on the inner face of the electric discharge container 2 on which the high voltage side electrode (for example, one electrode 31) is formed, whereby the electric charges move toward the low voltage side electrode (for example, the other electrode 32). When the electric discharge gas is argon and sulfur hexafluoride, the electric discharge gas is ionized in response to the electric charges, so that argon ions and fluoride ions are formed. The excimer molecules that consist of argon and fluoride are formed from these ions, so that ultraviolet rays with a wavelength of 193 nm are generated. The electric discharge container 2 is exposed to the fluoride ions at this time, and since the electric discharge container 2 is made of sapphire, YAG, or single crystal yttria so that its reactivity with halogen ions is low, the electric discharge container 2 can be used for a long time. Furthermore, since, unlike the prior art, the airtight electrical discharge space 23 is formed without using a resin component for the present electric discharge container 2, there is no degradation problem of such a resin component.

Since the electric discharge container 2 has ultraviolet-rays permeability, it is possible to emit the 193 nm ultraviolet rays produced in the electrical discharge space 23 to the outside thereof.

The chip pipe 4 is made of metal material or an alloy material in order to form the sealing portion 41 of the excimer discharge lamp 1 according to the first embodiment. For this reason, at time of lamp lighting, both the low voltage side electrode (hereinafter, for example, the other electrode 32) and the chip pipe 4, are also in a low-voltage state with respect to the high voltage side electrode (hereinafter, for example, one electrode 31), so that an electric field may be generated between the high voltage side electrode 31 and the chip pipe 4. At this time, electric charges are accumulated in the inner face 211 of the side wall 21 on which the high voltage side electrode 31 is provided, so that the electric charges may cause electric discharge toward the chip pipe 4. There is a high possibility that this electric discharge occurs in the shortest distance (portion) L since the electric discharge tends to occur in a portion where electric resistance thereof is the lowest between the chip pipe 4 and the inner face 211 of the side wall 21 on which the high voltage side electrode 31 is provided. In the excimer discharge lamp 1 according to the first embodiment, the partition member 8 made of sapphire, YAG, or single crystal yttria is formed, in the shortest distance (portion) L between the chip pipe 4 and the inner face of the side wall 21 on which the pair of electrodes 31 and 32 is provided. The electric resistance nature of the partition member 8 is higher than that of the chip pipe 4, and is also higher than the electric resistance nature of the electrodes 31 and 32. For this reason, according to the first embodiment, it is possible to make the resistance high, by providing the partition member 8 between the chip pipes 4 and the inner face on which the pair of electrodes 31 and 32 is provided, thereby suppressing generation of such electric discharge.

Figure 4A:
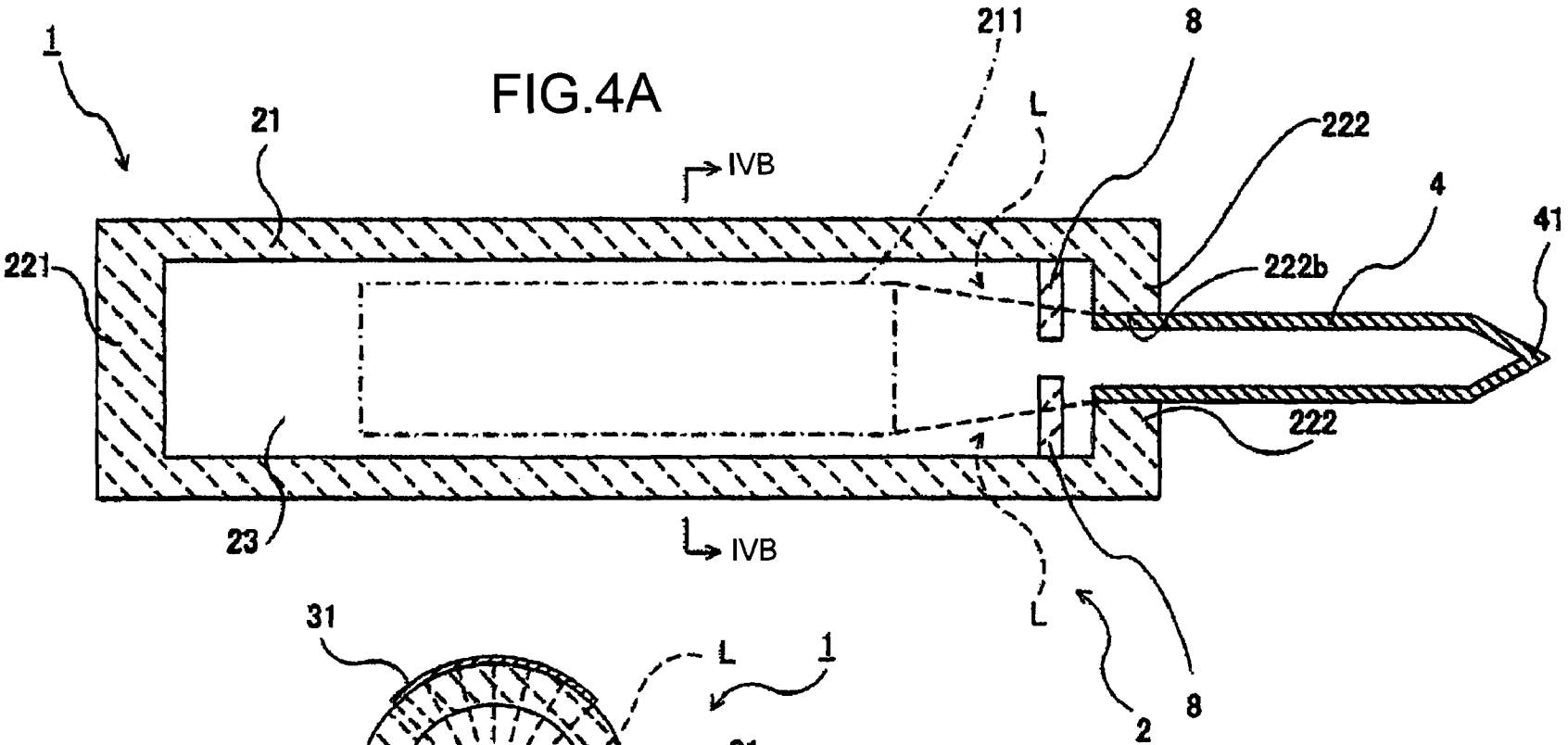
FIGS. 4A and 4B are explanatory diagrams of an excimer discharge lamp according to the present invention.
Figure 4B:
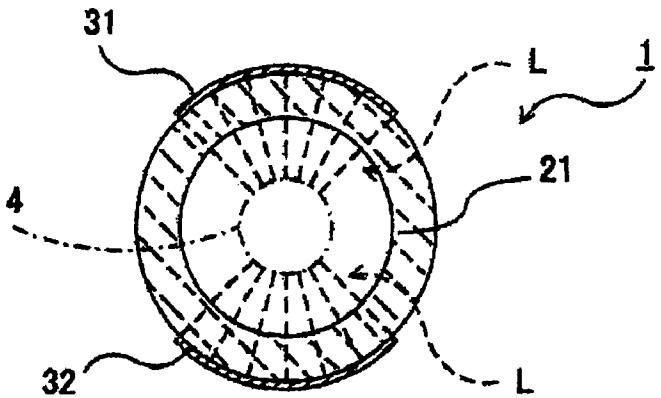

In FIGS. 1 and 2, since the electric discharge container 2 is a rectangular parallelepiped, which is rectangular in a cross sectional view taken in a direction perpendicular to a longitudinal direction thereof, and since the chip pipe 4 is tubular, the shortest distance L between the chip pipe 4 and the inner face 211 of the side wall 21, on which the pair of electrodes 31 and 32 is provided, can be shown as the straight line segments L. Therefore, what is required in the case is that the partition member 8 is provided between (on) this line segment L. On the other hand, in case where the electric discharge container 2 is a circular tube, which is circular in a cross sectional view taken in a direction perpendicular to a longitudinal direction thereof, and the chip pipe 4 is circular tube, a pair of electrodes 31 and 32 each of which is an arc shape in a cross sectional view thereof and which is formed on an outer face of the electric discharge container 2, is used. FIGS. 4A and 4B show such a case. FIG. 4A is a cross sectional view of the electric discharge container 2, taken in a longitudinal direction thereof, and FIG. 4B is a cross sectional view thereof taken along the line IVB-IVB of FIG. 4A. Although FIG. 4B shows the position of the chip pipe 4 shown in FIG. 4A, the position of a partition member 8 is omitted. In the excimer discharge lamp 1 of FIGS. 4A and 4B, the shortest distance (portion) L between the chip pipe 4 and an inner face 211 of a side wall 21, on which a pair of electrodes 31 and 32 is provided, may correspond to (may be shown as) a face that is formed by drawing a plurality of line segments Las shown in FIG. 4B, since the central axis of the chip pipe 4 is arranged so as to be in agreement with the central axis of the electric discharge container 2. For this reason, in the excimer discharge lamp 1 of FIGS. 4A and 4B, it is possible to make electric resistance high between the chip pipes 4 and the inner face on which the pair of electrodes 31 and 32 is provided, by arranging the partition member 8 over the entire shortest distance (portion) L which is in shape of a face, thereby suppressing generation of such electric discharge.

In addition to the first embodiment, FIGS. 5A to 5D show other embodiments according to the present invention.

Figure 5A:
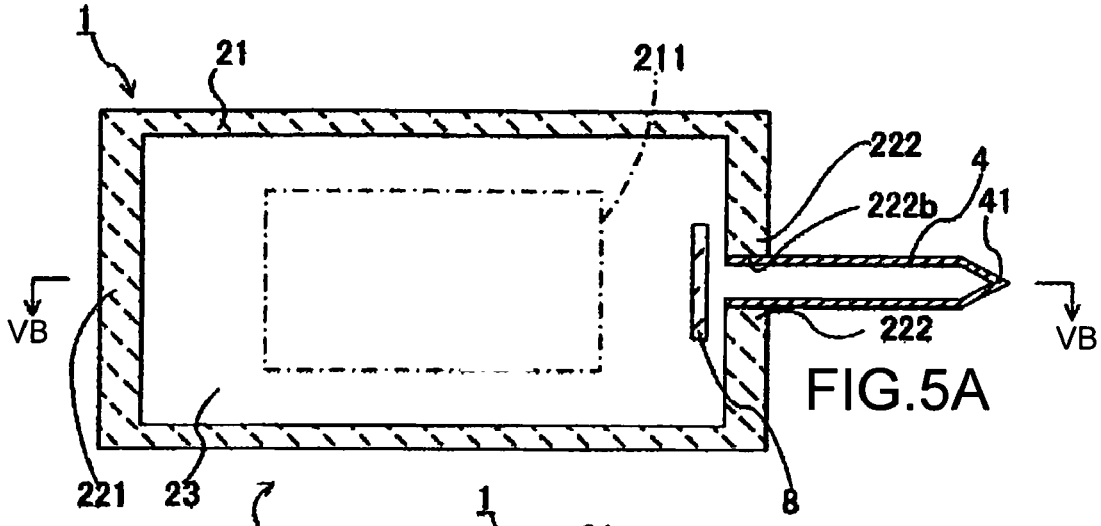
FIGS. 5A-5D are explanatory diagrams of an excimer discharge lamp according to the present invention.
Figure 5B:
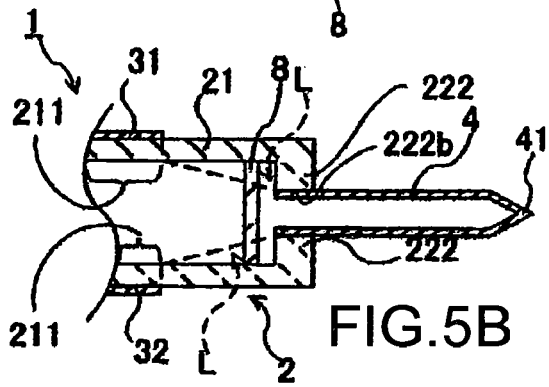

FIG. 5A is an explanatory cross sectional view of an excimer discharge lamp 1 according to a second embodiment, taken in a longitudinal direction of an electric discharge container 2. FIG. 5B is a sectional view of the lamp 1, taken along the line VB-VB of FIG. 5A. In addition, in FIGS. 5A and 5B, the same numerals as those in FIGS. 1 and 2 are assigned to the same structures as those shown in FIGS. 1 and 2.

FIGS. 5A and 5B are different from FIGS. 1 and 2, in that, the partition member 8 is formed not in a shape of a ring, but in a shape of a plate. In the description of the structure according to the second embodiment, which is shown in FIGS. 5A and 5B, the differences from that of FIGS. 1 and 2 will be described below, while similarities will not be.

Since the partition member 8 is in the shape of a plate, the partition member 8 is located not only between the shortest distance L between the chip pipe 4 and the inner face 211 of the side wall 21 on which the pair of electrodes 31 and 32 is provided, but also in every space through which a straight line connecting the chip pipe 4 and the inner face 211 passes. Thereby, the chip pipe 4 and the inner face 211 of the side wall 21 on which a pair of electrodes 31 and 32 is provided, do not face each other directly.

In the first embodiment, since there is a portion of the hole of the center of the partition member 8, where the chip pipe 4 and the inner faces 211 of the side wall 21 on which the pair of electrodes 31 and 32 is provided, face each other directly, electric discharge may arise in the portion in which they face each other, as voltage impressed at time of lamp lighting goes up to high voltage. For this reason, in the second embodiment, since the partition member is provided, so that the chip pipe 4 and the inner face 211 on which the pair of electrodes 31 and 32 is provided, do not face directly each other, it is possible to make the electric resistance high, thereby suppressing generation of such electric discharge.

Figure 5C:
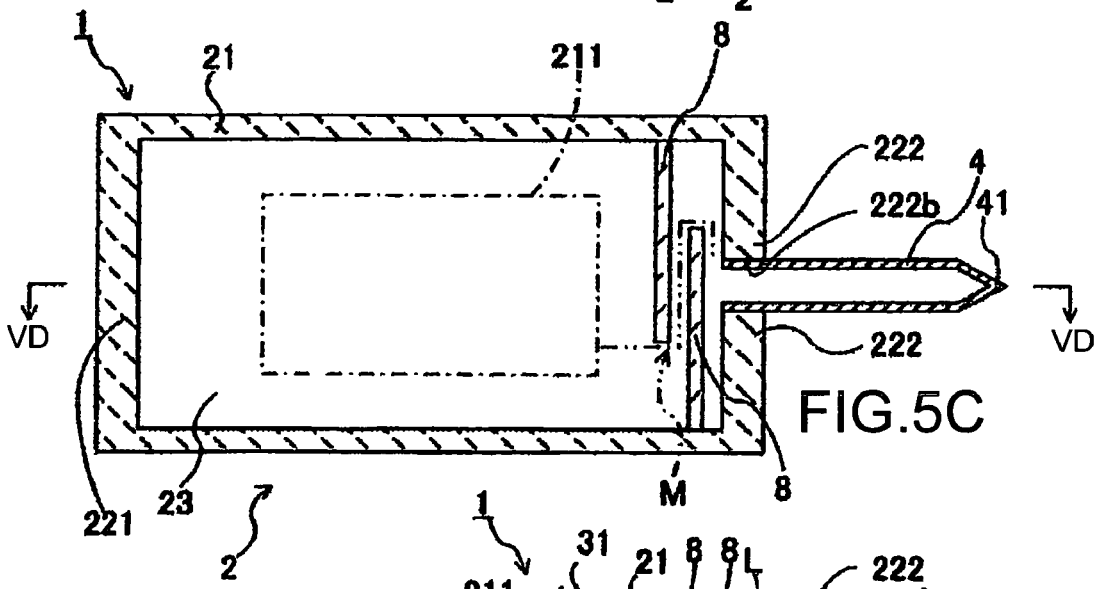
Figure 5D:
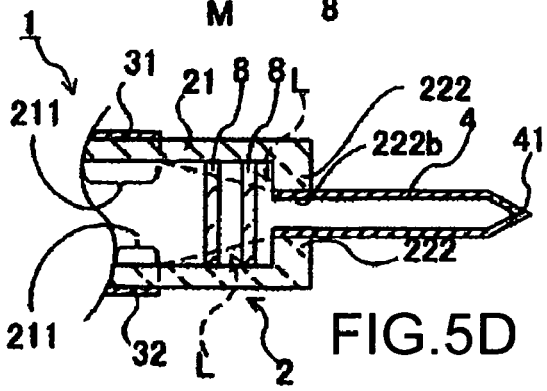

FIG. 5C is an explanatory cross sectional view of an excimer discharge lamp 1 according to a third embodiment, taken in a longitudinal direction of an electric discharge container 2. FIG. 5D is a cross sectional view of the lamp 1 of FIG. 5C, taken along the line VD-VD of FIG. 5C. In addition, in FIGS. 5C and 5D, the same numerals as those in FIGS. 1 and 2 are assigned to the same structural elements as those shown in FIGS. 1 and 2.

The lamp 1 shown in FIGS. 5C and 5D is different from that shown in FIGS. 1 and 2, in that a flow path formed by partition members 8 and the electric discharge container 2 winds its way between the partition member 8. In the description of the structure according to the third embodiment, which is shown in FIGS. 5C and 5D, the differences from FIGS. 1 and 2 will be described below, while the similarities will not be.

In the third embodiment, the partition members 8 are respectively in a shape of a plate, and the number of these plate shaped partition members 8 is two. When the electric discharge container 2 has the shape for example, of a rectangular parallelepiped, the side wall 21 thereof is made up of four (4) faces. One partition member 8 (on the left hand side in the figures) is formed so as to be brought in contact with three faces of the side wall 21. Although another partition member 8 (on the right hand side in the figures) is also brought in contact with the three faces of the side wall 21, one of the three faces of the side face 21, which is in contact with the another partition member 8, is different from any one of those faces, which is in contact with the one partition member 8, as shown in FIG. 5C. The partition members 8, which are provided in such a way, are located not only on the shortest distance L between the chip pipe 4 and the inner face 211 of the side wall 21 on which the pair of electrodes 31 and 32 is provided, but also in every space through which a straight line connecting the chip pipe 4 and the inner face 211 passes. Thereby, the chip pipe 4 and the inner face 211 of the side wall 21 on which the pair of electrodes 31 and 32 is formed do not face each other directly. Moreover, the pair of partition members 8 forms a winding flow path with the electric discharge container 2 and the pair of partition members 8. In addition, as shown in FIG. 5C, the winding flow path M is a flow path in the electric discharge container 2, which is formed from the inner face 211 of the side wall 21, on which the pair of electrodes are formed, to the chip pipe 4, so that the flow path winds its way, two or more times by the partition members 8.

In the description of the first embodiment, electric charges, which are accumulated in the inner face 211 of the side wall 21 on which the pair of electrode 31 and 32 is provided, move directly toward the chip pile 4, thereby causing electric discharge between the chip pile 4 and the inner face 211. However, in addition to such electric discharge, there is the so-called creeping discharge, which occurs when the electric charges accumulated in the inner face 211 of the side wall 21 moves along with the inner face of the electric discharge container 2, thereby reaching the chip pipe 4 provided in the electric discharge container 2. In the third embodiment, because the winding flow path formed by the electric discharge container 2 and the pair of partition members 8, a face along which the electric charges move is created. For this reason, in the structure of the third embodiment, the creepage distance between the chip pile 4 and the inner face 211 of the side wall 21 on which the pair of the electrodes 31 and 32 is provided, becomes long so that it is possible to suppress electric discharge to the chip pipe 4, which is the creeping discharge.

Moreover, in the third embodiment, since the chip pipe 4 and the inner face 211 of the side wall 21 on which the pair of electrodes 31 and 32 is provided, do not face each other directly due to the partition members 8, the effects of the first embodiment and the second embodiment can be acquired.

FIGS. 6A, 6B, 6C, and 6D show examples of a winding flow path formed by an electric discharge container 2 and a partition member 8.

Figure 6A:
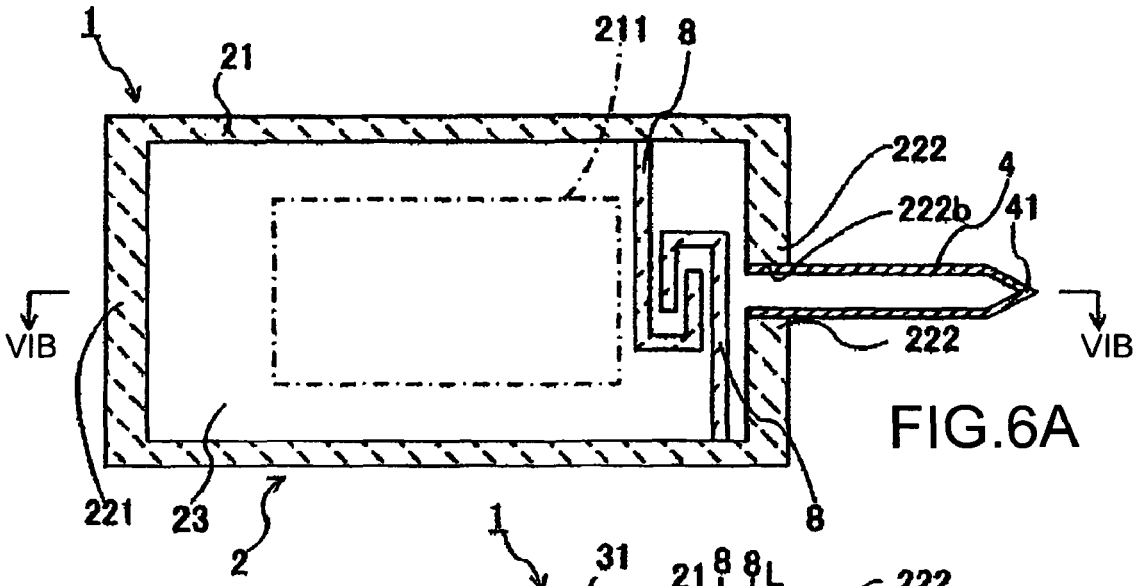
FIGS. 6A-6D are explanatory diagrams of an excimer discharge lamp according to the present invention.
Figure 6B:
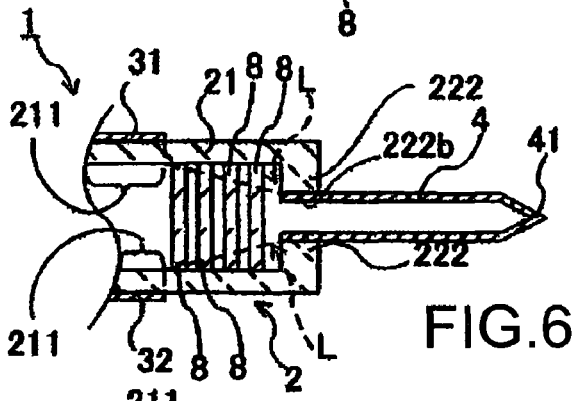

FIG. 6A is an explanatory cross sectional view of an excimer discharge lamp 1 according to a fourth embodiment, taken in a longitudinal direction of the electric discharge container 2. FIG. 6B is a cross sectional view of the lamp 1 of FIG. 6A, taken along the line VIB-VIB of FIG. 6A. In addition, in FIGS. 6A and 6B, the same numerals as those in FIGS. 5C and 5D are assigned to the same structural elements as those shown in FIGS. 5C and 5D.

The shape of partition members 8 shown in FIGS. 6A and 6B are different from those shown in FIGS. 5C and 5D. In the description of the structure according to the fourth embodiment, which is shown in FIGS. 6A and 6B, the differences from FIGS. 5C and 5D will be described below, while the similarities will not be.

The partition members 8 have an L-shaped structure which is respectively bent twice. The pair of partition members 8 is arranged so that an S-shaped winding flow path is formed. Thereby, in the fourth embodiment, the flow path formed by an electric discharge container 2 and a pair of partition plates 8 winds its way for a longer distance than that of the third embodiment.

In the fourth embodiment, since the flow path is formed by the electric discharge container 2 and the partition members 8, the same effects of the third embodiment can be acquired.

Figure 6C:
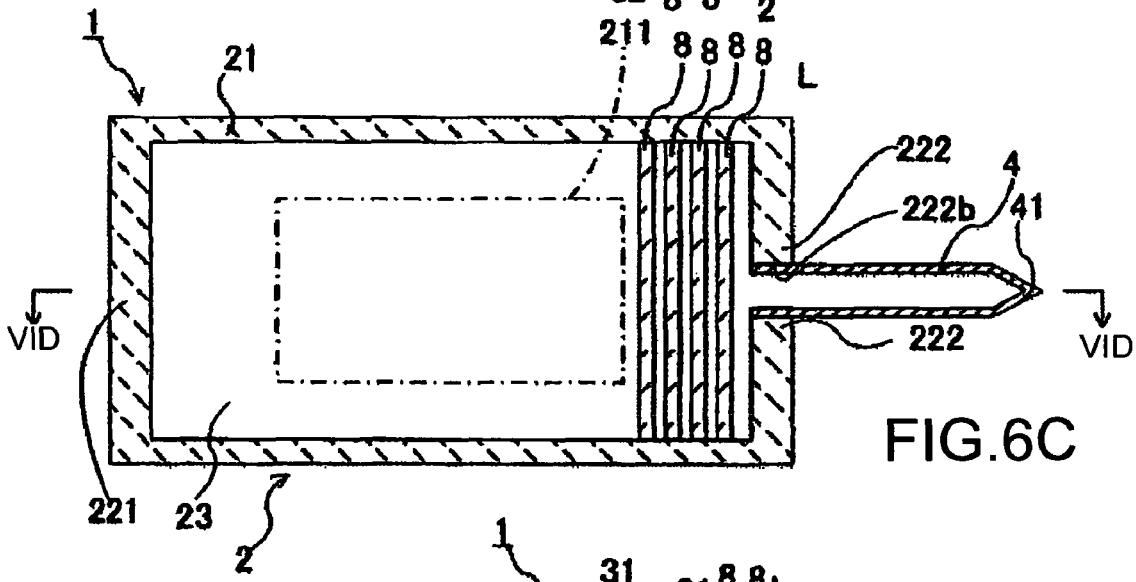
Figure 6D:
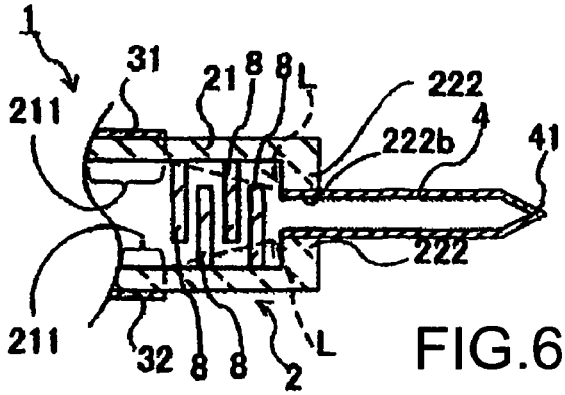

FIG. 6C is a cross sectional view of an excimer discharge lamp 1 according to a fifth embodiment, taken along in a longitudinal direction of an electric discharge container 2. FIG. 6D is a cross sectional view of the lamp 1 of FIG. 6C, taken along the line VID-VID of FIG. 6C. In addition, in FIGS. 6C and 6D, the same numerals as those in FIGS. 5C and 5D are assigned to the same structural elements as those shown in FIGS. 5C and 5D.

The lamp 1 shown in FIGS. 6C and 6D is different from that shown in FIGS. 5C and 5D, in that the number of partition members 8 shown in FIGS. 6C and 6D is four (4). In the description of the structure according to the fifth embodiment, which is shown in FIGS. 6C and 6C, the differences from FIGS. 5C and 5D will be described below, while the similarities will not be.

In the fifth embodiment, the electric resistance between a chip pipes 4 and a side wall 21 on which a pair of electrodes 31 and 32 is provided can be increased, and the winding flow path formed by an electric discharge container 2 and the partition members 8 can be lengthened. Thereby, for the electric charges accumulated in the side wall 21, the creepage distance to the chip pipe 4 is elongated.

In the fifth embodiment, since the flow path is formed by the electric discharge container 2 and the partition members 8, the same effects of the third embodiment can be acquired.

Figure 7A:
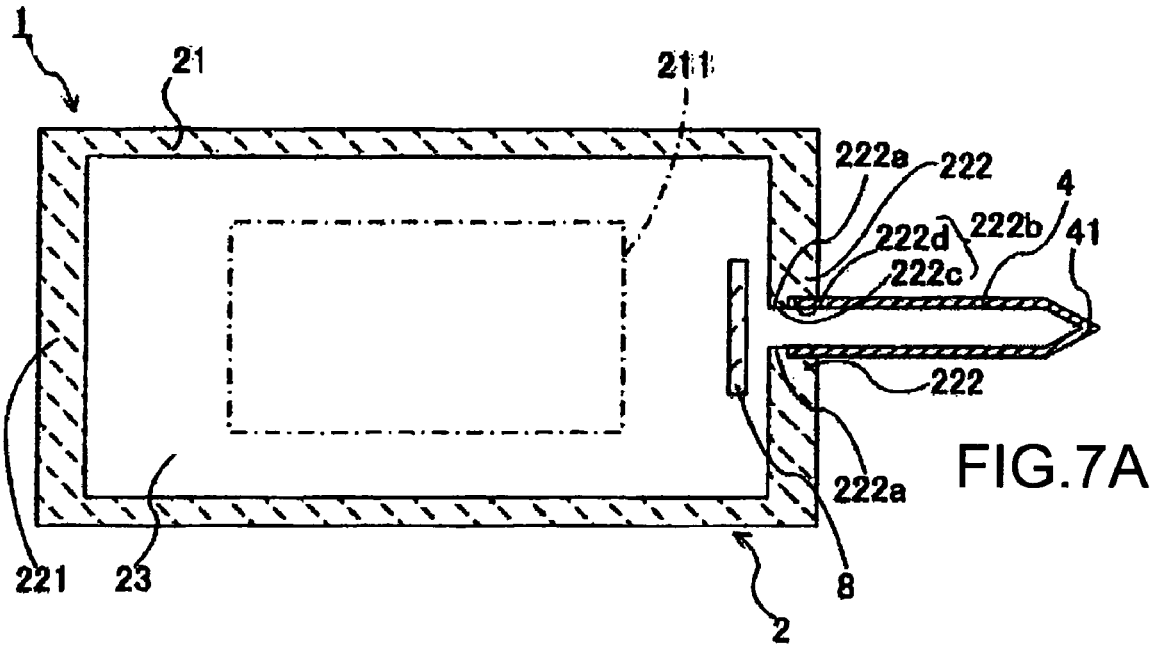
FIGS. 7A and 7B are explanatory diagrams of an excimer discharge lamp according to the present invention.
Figure 7B:
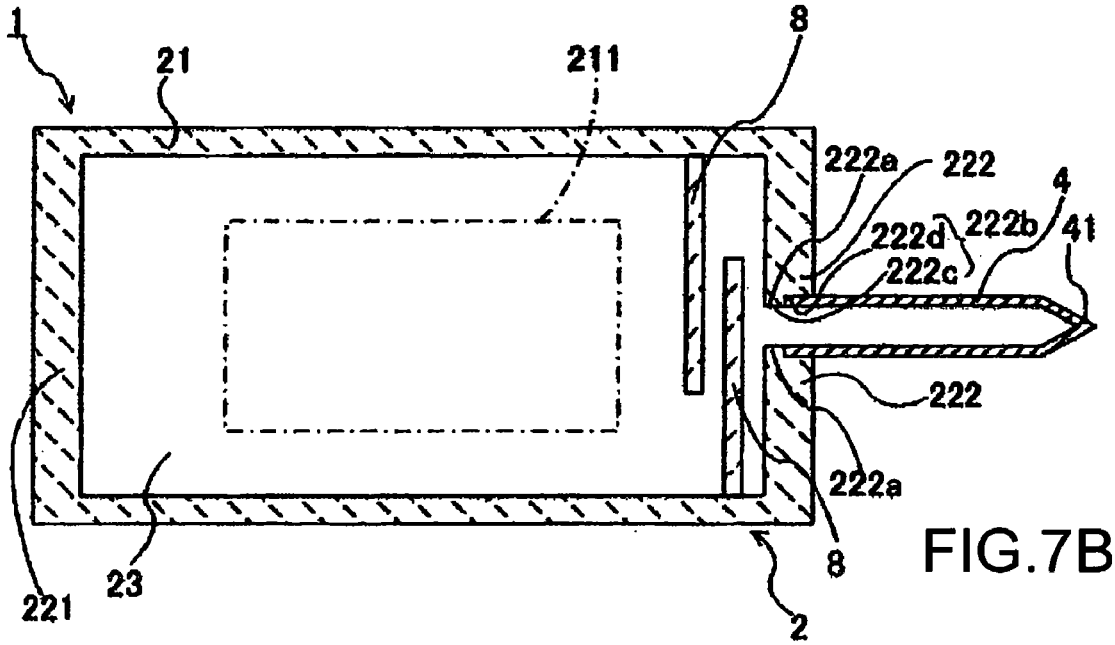

FIGS. 7A and 7B show an example 2 in which a dividing wall is formed in addition to partition members 8 as means for increasing the electric resistance between a chip pipe 4 and an inner faces 211 of a side wall 21 on which a pair of electrodes 31 and 32 is formed.

FIG. 7A is an explanatory cross sectional view of an excimer discharge lamp 1 according to a sixth embodiment, taken in a longitudinal direction of an electric discharge container 2. In addition, in FIG. 7A, the same numerals as those in FIG. 5A are assigned to the same structural elements as those shown in FIG. 5A.

FIG. 7A is different from FIG. 5A, in that the dividing wall 222*a* is provided. In the description of the structure according to the sixth embodiment, which is shown in FIG. 7A, the differences from FIG. 5A will be described below, while the similarities will not be.

A hole 222*b* that penetrates a center of another end wall 222 is provided therein. This hole 222*b* is made up of a small diameter hole 222*c* located in a left side of the figure, and a large diameter hole 222*d*, which is continuous from the small diameter hole 222*c*, and has a larger diameter than that of the small diameter hole 222*c*. A level difference is formed between the small diameter hole 222*c* and the large diameter hole 222*d*, that is, the level difference serves as the dividing wall 222*a*. This dividing wall 222*a* is made of sapphire, YAG, or single crystal yttria. Consequently, in the sixth embodiment, the dividing wall 222*a* is provided on the shortest distance (portion) L between the chip pipe 4 and the inner face 211 of the side wall 21 on which the one electrode 31 is formed, and, in addition, the partition 222*a* is provided in the shortest distance L between the chip pipe 4 and the inner face 211 of the side wall 21 on which the other electrode 32 is formed.

In the sixth embodiment, in addition to the partition member 8, the dividing wall 222*a* is formed between the chip pipes 4 and the inner faces 211 of the side wall 21 on which the pair of electrodes 31 and 32 is formed, the electric resistance therebetween can be increased so that it is possible to suppress the electric discharge to the chip pipe 4.

FIG. 7B is an explanatory cross sectional view of an excimer discharge lamp 1 according to a seventh embodiment, taken along a longitudinal direction of an electric discharge container 2. In addition, in FIG. 7B, the same numerals as those in FIG. 5C are assigned to the same structures as those shown in FIG. 5C.

FIG. 7B is different from FIG. 5C, in that a dividing wall 222*a* is provided. In the description of the structure according to the seventh embodiment, which is shown in FIG. 7B, the differences from FIG. 5C will be described below, while the similarities will not be.

In the seventh embodiment, since the dividing wall 222*a* is formed, the same effects as those of the sixth embodiment can be acquired. Such a dividing wall 222*a* may be applied to the first, fourth, and fifth embodiment.

Next, an experiment showing the effects of the excimer discharge lamp according to the second and third embodiments will be described below. In the experiment, three kinds of excimer discharge lamps were prepared. One of these three kinds of lamps was prepared as a comparative example, and the remaining two were prepared according to the present invention. The excimer discharge lamp 1 shown in FIG. 8 was used as the comparative example, the excimer discharge lamp 1 shown in FIGS. 5A and 5B was used as Invention 1, and the excimer discharge lamps 1 shown in FIGS. 5C and 5D was used as Invention 2. The comparative example of FIG. 8 was different from that shown in FIGS. 5A and 5B, in that the partition member 8 was not provided.

Compared with the comparative example, this experiment shows the effects of the suppression of electric discharge in case where the partition member 8 was provided (FIGS. 5A and 5B) and the effects of the suppression of the creeping discharge in the case where the winding flow path was formed by the partition member 8 and the electric discharge container 2 (FIGS. 5C and 5D).

In each excimer discharge lamp, the other electrode (not shown in FIG. 8) was removed, and a power supply was connected to the one electrode (not shown in FIG. 8) and the chip pipe 4. The respective excimer discharge lamps had a common structure in that sapphire was used for the electric discharge container 2, the chip pipe 4 formed by calcinating paste-like copper to a nickel electrode was used, and argon gas was used for the electric discharge gas. In the Inventions 1 and 2, sapphire was used for the partition member 8 and the partition member 8 was joined to the electric discharge container 2 by pressing and heating.

The common specification of these excimer discharge lamps 1 will be given below. The width of the electric discharge container 2 (the length thereof in an up-and-down direction of FIG. 5A) was 45 mm. The length of the electric discharge container (the length thereof in a horizontal direction of FIG. 5A) was 65 mm. The height of the electric discharge container 2 (the length thereof in a front-back direction of FIG. 5A) was 6 mm. The thickness of the electric discharge container 2 was 1 mm. The sealing pressure of the electric discharge gas was 13.3 kPa and the distance from the electrode to an end wall was 10 mm.

The specification of the partition member 8 according to Invention 1 will be given below. The width thereof (the length thereof in an up and down direction of FIG. 5A) was 15 mm. The length thereof (the length in a horizontal direction of FIG. 5A) was 8 mm. The height thereof (the length in a front-and-back direction of FIG. 5A) was 4 mm.

The specification of the partition member 8 according to Invention 2 will be given below. The width of the partition member 8 in a left side of FIG. 5C (the length thereof in an up-and-down direction of FIG. 5C) was 4 mm. The length of the partition member 8 in a left side of FIG. 5C (the length in a horizontal direction of FIG. 5C) was 3 mm. The height of the partition member 8 in a left side of FIG. 5C (the length in a front-and-back direction of FIG. 5C) was 27 mm. The width of the partition member 8 in a right side of FIG. 5C (the length thereof in an up-and-down direction in FIG. 5C) was 4 mm. The length of the partition member 8 in a right side of FIG. 5C (the length thereof in a horizontal direction of FIG. 5C) was 3 mm. The height of the partition member 8 in a right side of FIG. 5C (the length thereof in a front-and back direction of FIG. 5C) was 27 mm.

Figures 8, 9:
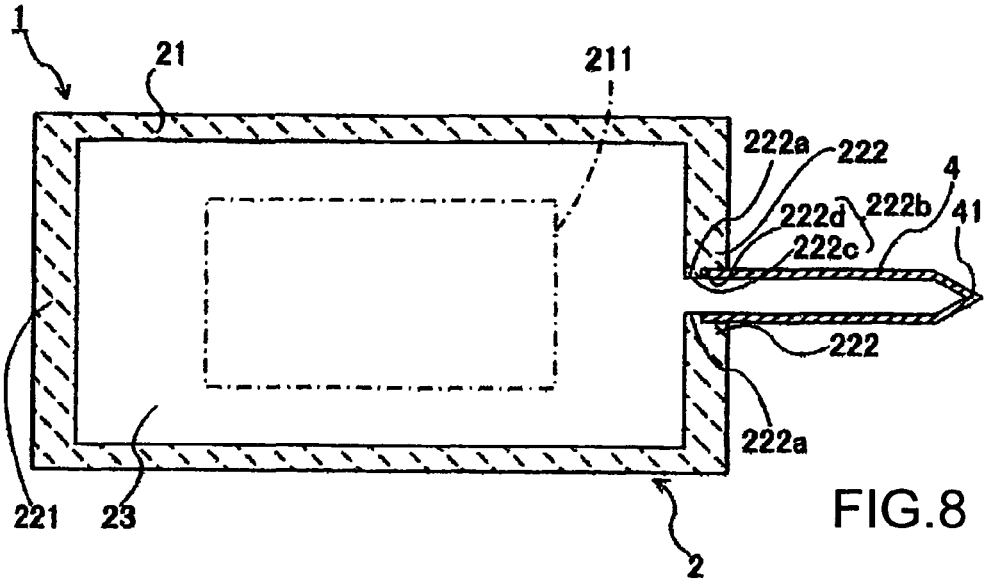
FIG. 8 is an explanatory diagram of an excimer discharge lamp according to the present invention.
FIG. 9 is an explanatory diagram showing experimental results.
Figure 10:
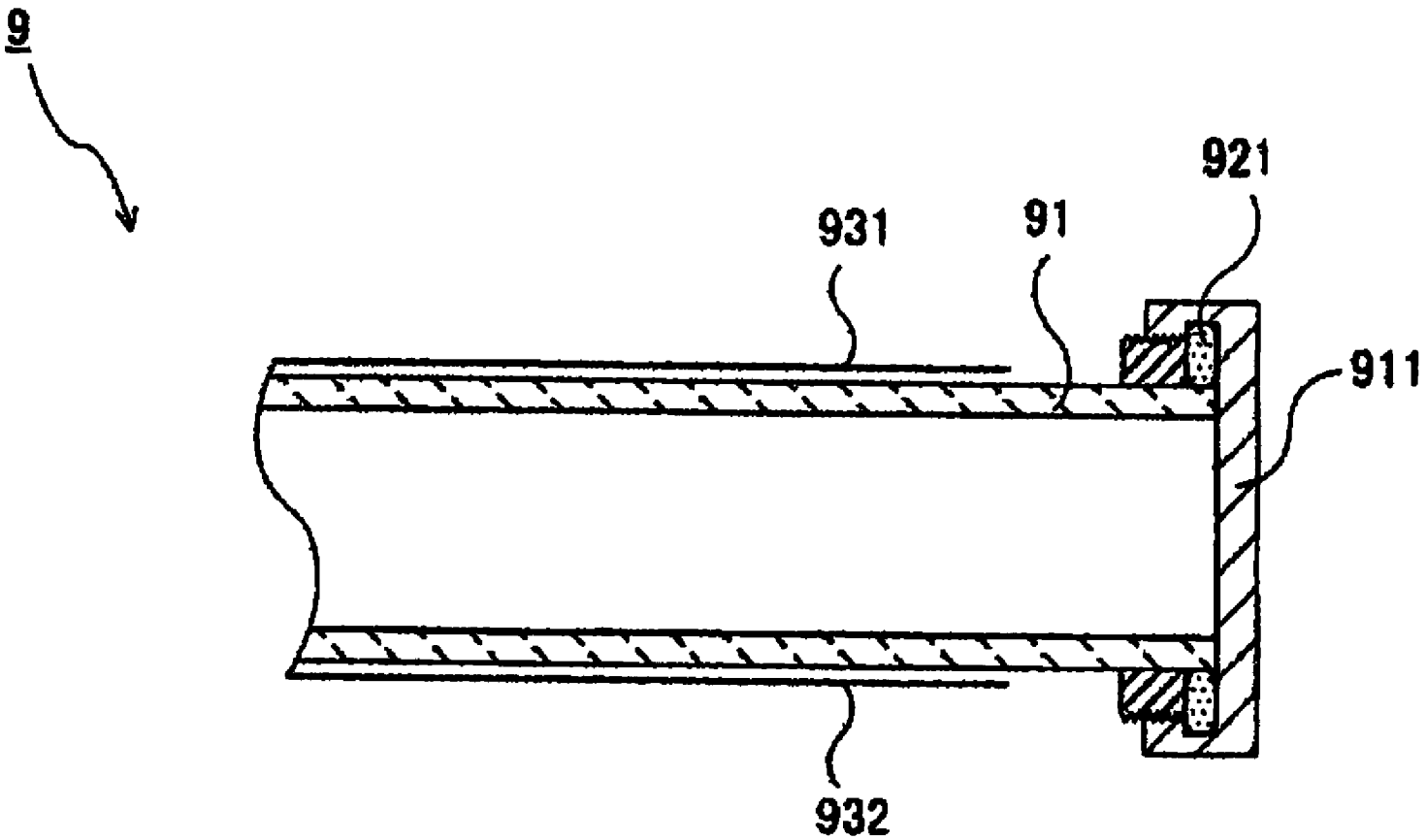
FIG.10 Prior Art
FIG. 10 is an explanatory diagram of a conventional excimer discharge lamp.
Figure 11:
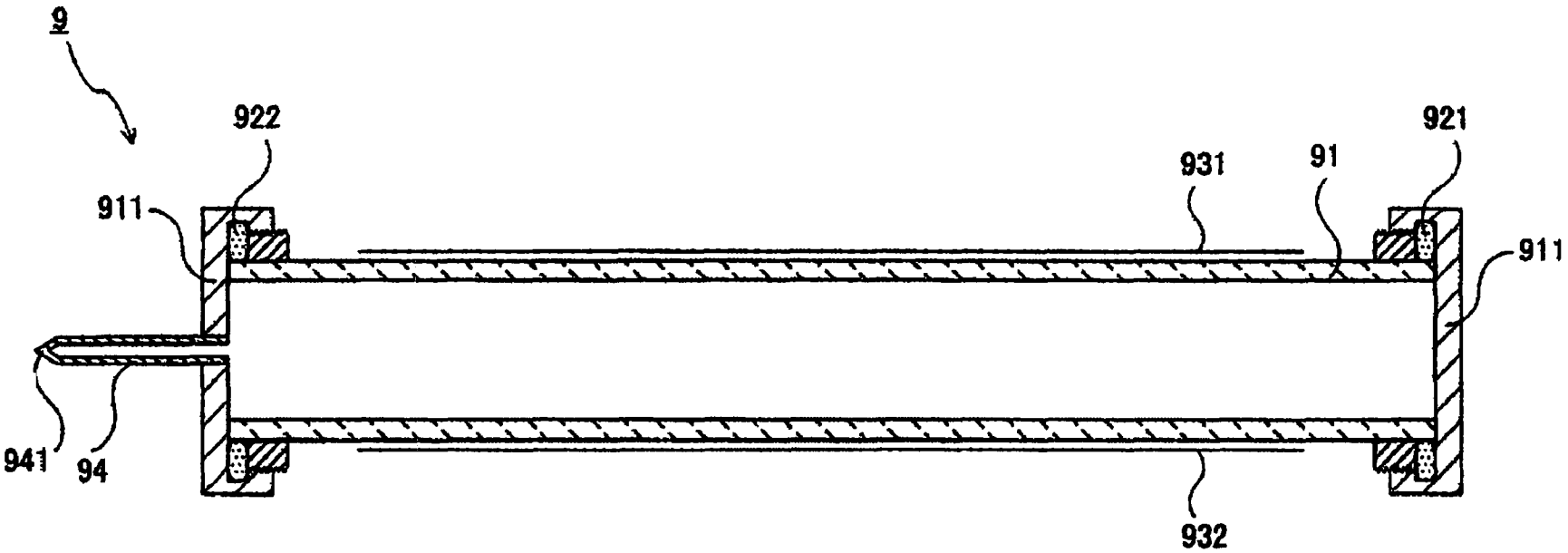
FIG. 11 is an explanatory diagram of an excimer discharge lamp for explaining a subject matter.

In the experiment, the electrode was used as a high voltage side electrode, and the chip pipe was connected to a power supply as a ground side electrode, voltage (electric discharge starting voltage) was measured until electric discharge started between the electrode and the chip pipe. The electric discharge starting voltage of the respective excimer discharge lamps 1 was measured twelve times respectively, and an average value thereof was calculated, respectively. FIG. 9 shows the experimental result.

In the comparative example, although there were the electric discharge suppression effects since the partition 222*a* was provided on the end wall 222 that was located on the shortest distance (portion) L between the chip pipe 4 and the inner face 211 of the side wall 21 on which the high voltage side electrode was formed, electric discharge started at an average of 5.1 kV (p-p).

On the other hand, in Invention 1, electric discharge starting voltage was an average of 6.1 kV (p-p), which was 1 kV higher than that of the comparative example, since the partition member 8 was provided in the Invention 1. This is because the partition member 8 was provided in the shortest distance (portion) L between the chip pipe 4 and the inner face 211 of the side wall 21 on which the high voltage side electrode was formed, so that the electric resistance between the shortest distance L was increased. Moreover, since the chip pipe 4 and the inner face 211 of the side wall 21 on which the electrode was formed do not face each other directly due to the partition member 8, the electric resistance could be further increased therebetween so that it was possible to suppress generation of electric discharge therebetween.

In the invention 2, the electric discharge starting voltage became 9 kV (p-p) or more, namely, electric discharge did not start between the high voltage side electrode and the chip pipe 4. Since the flow path was formed by the pair of partition members 8 and the electric discharge container 2, not only the electric resistance could be increased between the chip pipes 4 and the inner face 211 of the side wall 21 on which the electrode was formed, but the creepage distance therebetween could be also lengthened, so that it was possible to suppress the creeping discharge. For this reason, it would appear that even if high voltage of 9 kV (p-p) or more was impressed, electric discharge did not start.

Thus, in the excimer discharge lamp 1 according to the second embodiment, since the partition member 8 was provided between the chip pipe 4 and the inner face 211 of the side wall 21 on which the electrode was provided so as not to face each other directly, it was possible to increase electric resistance therebetween, which suppresses the electric discharge. In addition, in the excimer discharge lamp according to the third embodiment, the pair of partition members 8 is provided between the chip pipe 4 and the inner face 211 of the side wall 21 on which the electrode is formed so as not to face each other, and the winding flow path is formed between the pair of the partition members 8 and the electric discharge container 2, which make it possible to increase the electric resistance therebetween, thereby suppressing not only electric discharge but also creeping discharge.

The preceding description has been presented only to illustrate and describe exemplary embodiments of the present excimer discharge lamp. It is not intended to be exhaustive or to limit the invention to any precise form disclosed. It will be understood by those skilled in the art that various changes may be made and equivalents may be substituted for elements thereof without departing from the scope of the invention. In addition, many modifications may be made to adapt a particular situation or material to the teachings of the invention without departing from the essential scope. Therefore, it is intended that the invention not be limited to the particular embodiment disclosed as the best mode contemplated for carrying out this invention, but that the invention will include all embodiments falling within the scope of the claims. The invention may be practiced otherwise than is specifically explained and illustrated without departing from its spirit or scope.

What is claimed is:

1. An excimer discharge lamp comprising:

an electric discharge container with an electric discharge space;

a pair of electrodes provided on an outer face of the electric discharge container; and an electric discharge gas enclosed in the electric discharge space, wherein the electric discharge gas is made of at least rare gas and halogen or halide, wherein the electric discharge container has a tubular side wall, wherein a one end wall seals one end of the tubular side wall, wherein another end wall is on the other side of the tubular side wall, wherein the tubular side wall and the end walls are made of sapphire, YAG, or single crystal yttria, wherein a chip pipe is provided on the another end wall, and wherein a partition member made of sapphire, YAG, or single crystal yttria is formed between a shortest distance of the chip pipe and the inner face of the tubular side wall where the pair of electrodes are formed.

2. The excimer discharge lamp according to claim 1, wherein multiple partition members and the electric discharge container form a winding flow path.

3. The excimer discharge lamp according to claim 1, wherein a dividing wall made of sapphire, YAG, or single crystal yttria is on the one end wall located in the shortest distance between the chip pipe and the inner face of the tubular side wall where the pair of electrodes is provided.

4. The excimer discharge lamp according to claim 2, wherein a dividing wall made of sapphire, YAG, or single crystal yttria is on the one end wall located in the shortest distance between the chip pipe and the inner face of the tubular side wall where the pair of electrodes is provided.

5. The excimer discharge lamp according to claim 1, wherein the chip pipe is made of metal or alloy.

6. An excimer discharge lamp comprising:

an electric discharge container with an electric discharge space;

a pair of electrodes provided on an outer face of the electric discharge container; and an electric discharge gas enclosed in the electric discharge space, wherein the electric discharge gas is made of at least rare gas and halogen or halide, wherein the electric discharge container has a tubular side wall, wherein a one end wall seals one end of the tubular side wall, wherein another end wall is on the other side of the tubular side wall, wherein the tubular side wall and the end walls are made of sapphire, YAG, or single crystal yttria, wherein a chip pipe is provided on the another end wall, and wherein a partition member is formed between the chip pipe and the inner face of the tubular side wall where the pair of electrodes are formed.

7. The excimer discharge lamp according to claim 6, wherein the chip pipe is made of metal or alloy.

* * * * *